US012311286B1

(12) United States Patent
Vermeiren

(10) Patent No.: US 12,311,286 B1
(45) Date of Patent: May 27, 2025

(54) RACE CIRCUIT

(71) Applicant: Sebastien Vermeiren, Munich (DE)

(72) Inventor: Sebastien Vermeiren, Munich (DE)

(73) Assignee: Sebastien Vermeiren, Munich (DE)

( * ) Notice: Subject to any disclaimer, the term of this patent is extended or adjusted under 35 U.S.C. 154(b) by 0 days.

(21) Appl. No.: 18/417,817

(22) Filed: Jan. 19, 2024

(51) Int. Cl.
*A63K 1/00* (2006.01)
*A63F 3/00* (2006.01)

(52) U.S. Cl.
CPC ..... *A63K 1/00* (2013.01)

(58) Field of Classification Search
CPC .... A63K 1/00; A63K 1/02; A63F 3/00; A63F 3/00082
USPC ..... 472/85
See application file for complete search history.

(56) References Cited

U.S. PATENT DOCUMENTS 5,941,173 A * 8/1999 Schier ..... A63G 25/00 472/85
2019/0022548 A1* 1/2019 Labowsky ..... A63K 1/00
2021/0031120 A1* 2/2021 Field ..... G06F 30/00

* cited by examiner

*Primary Examiner* — Kien T Nguyen
(74) *Attorney, Agent, or Firm* — Daniel C. Pierron; Widerman Malek, PL

(57) ABSTRACT

A racetrack including a racetrack portion with at least a first segment and a second segment being branched-off from the racetrack portion and being merged into the racetrack. The at least two segments are mostly identical in terms of length and/or travel time is proposed.

11 Claims, 11 Drawing Sheets

RACE CIRCUIT

FIELD OF THE INVENTION

The present invention relates to a racetrack design.

BACKGROUND OF THE INVENTION

In motorsport, several types of vehicles, driven by drivers/riders/pilots compete to be fastest around a track. These vehicles compete in motorsport series, called categories, for example (but not limited to) Formula 1, F2, F3, MotoGP, Moto2, Moto3, MotoE, WSBK IndyCar, Formula E, Nascar, WEC, Le Mans 24h, WRC, etc. The pilots of the race complete several laps around the track to form a race. The winner is the one that completes the race distance (i.e., the total number of laps) the fastest. In order to do that, the pilot tries to race as fast as possible and if necessary to overtake the pilot in front of them on the track.

All the vehicles used for racing produce some level of aerodynamic disturbance behind them (vortices), as they travel through air at high speed. As a general rule, the more downforce the vehicles produce and the bigger the vehicle, the more air disturbance they generate behind them. The development objective of most race vehicles is to produce a large amount of downforce, as it helps them traveling through the corners faster. Hence creating a vast zone of disturbed air behind them.

It happens that a pilot (called "Pilot B", or "B") is faster than the pilot ("Pilot A", or "A") racing in front of him/her (because B has better skills, better tire wear, better car, better set-up, etc).

In order to complete an overtaking maneuver on Pilot A, Pilot B needs to put together a certain number of conditions as shown in FIG. 1A and FIG. 1B, namely first get close behind Pilot A, see FIG. 1A, and depart from the optimal racing line that Pilot A usually takes, see FIG. 1B. Secondly, Pilot B's use his/her speed advantage to get alongside Pilot A and complete the overtake by returning to the optimal racing line ahead of the next curve.

The problem in most racing series is that the turbulent (or disturbed) air behind the leading vehicle significantly reduces the aerodynamic efficiency of the vehicle following. It means Pilot B will have less downforce available and will have issues following Pilot A closely through the corners as Pilot B has less adherence and more tire wear. The first condition to attempt an overtake is hence made very difficult by this phenomenon. In the example of motorbike racing, the turbulent air increases the front tire pressure of the following pilot, reducing adherence in the corner, and also reduces downforce of the motorbike behind, reducing the acceleration capacity of the following motorbike.

To complicate the matter, Pilot B will have to take a compromised racing line (or trajectory), reducing his/her speed advantage over Pilot A, at the moment where the speed advantage is the most necessary (during an overtake maneuver).

The combined effect is that in the high-end motorsport series, where the vehicles produce a lot of downforce and hence a lot of disturbance, the overtake maneuvers are complex to achieve. Often, the only possibilities to overtake are at the end of a long straight line, followed by a sharp turn.

The reason is that the wake of turbulent air reduces downforce, but also drag. That creates a slipstream effect, where a car following another one very closely, with similar power, will gain a speed advantage.

With a sharp turn, and hence a long breaking zone, the overtake maneuver has more chances to happen (provided the following car has enough downforce to follow closely at the exit of the turn just before the straight line).

In many cases, only when the following pilot has a very significant advantage over the leading pilot, can the following pilot complete a successful overtake maneuver and get in front of his/her rival. But when the speed difference is not very high, a faster pilot will not be able to get in front of the leading pilot. This problem has been known for a long time. Various measures have been tried and/or put in place to improve the race. They are briefly described below.

At the exception of the reduction of airflow disturbance, the measures are all aimed at artificially creating conditions in which two pilots will have a significant speed difference at a given moment in the race, high enough to allow for an overtake maneuver to take place.

In-Race Refuel

Some time ago, in F1 for example, the cars were re-fueled during the race, enabling different strategies. One strategy could be for example to start with a lot of fuel which is heavy and slows down the car but less stops are necessary to complete the race. An alternative strategy could be to start the race with low fuel which enables the car to be faster but requiring more stops to complete the race.

Pilots on different strategies would, at a given moment in the race, have significant difference in lap times and overtakes would take place more easily.

This has been banned in F1, partly on safety grounds (some cases of fires happened during the races while refueling). Another reason was to enable overtakes on track, while many overtakes at that time actually took place "remotely" when one car was refueling and the other one racing on track, without the entertainment value of a wheel-to-wheel overtake maneuver.

DRS (Drag Reduction System)

The DRS has been introduced in F1 in 2011. It enables the rear wing to open a slot in a straight line when a car is within 1 s of the car in front. This device reduces the drag generated by the rear wing, and increases the top speed, facilitating an overtake.

Its efficacy in enabling overtakes depends on the tracks (length of straight line, length of DRS-enabled zone, etc.). It is somewhat artificial and is not a beloved feature by racing fans, in general.

Temporary Boost

Some racing series, like Formula E, introduced varied forms of temporary boosts (fan boost, boost activated by driving in a specific zone of the track, etc.), unlocking more power for a short period of time, and enabling overtakes to happen.

It is effective, although it leaves the defender a bit powerless to fight back to keep his/her position.

Tires Allocation/Strategies

Overtakes require a big speed difference between two cars. One way of achieving this is to mandate the use of different tires during a race (as done in F1). The different tire compounds mix high degradation/high performance with low degradation/lower performance during a race, enabling different strategies to be chosen by the pilots and teams, and generating overtakes between pilots on different tires during the race as a consequence.

Reduction of Airflow Disturbance

Since 2022, F1 introduced regulations pushing the cars to rely their downforce generation more on ground effect, rather than on wings (front and rear). The downforce generated by ground effect is more aerodynamically efficient, and as such produces a smaller turbulent wake than a comparable downforce generated by wings. This enables the cars to follow each other more closely in the curves, facilitating overtakes in straight lines by virtue of the slipstream effect described earlier.

This measure has proven to be effective, although creating unexpected issues like porpoising (aerodynamic fluctuation of the ride-height).

Track Layout

Some effort has been made in track layouts, especially in newly created tracks (in opposition to long-established historic tracks), to create sequences of curves that favor overtake maneuvers. It has been variably successful.

Given this challenge, there is a need for innovative solutions that allow racetracks to be configured in a way that favors overtaking maneuvers while ensuring the safety of the racers.

The U.S. Pat. No. 7,357,727B2 describes a racetrack designed to accommodate various types of auto racing class including Indy, CART, Formula 1 etc. This proposed racetrack is a continuous closed circuit with at least two loops which loop about a common center area and with the racetrack passing over itself at least once by a nonlevel crossing such as an overpass so that the track does not have a level crossover and thereby allowing a vehicle making an entire circuit of the track the option of only making turns in one direction and not passing over any portion of the track more than once is a single circuit of the track.

The patent application EP1973619A4 describes a racetrack for conducting a fairer race around an oval track by configuring the track such that the runner in each lane runs an arc angle equal to the runners in other lanes. Such a configuration eliminates the disproportionate effect of centrifugal force on competitors running in inner lanes. Embodiments of the invention provide for the addition of a straight section to a standard oval track extending from the midpoint of a curved section and perpendicular to the existing straightaway section. Runners in each lane start at staggered locations on the straight section and proceed through a curved quadrant and to a finish line on the straightaway furthest away from the straight section. The staggered starting locations are chosen such that the runner in each lane travels an equal distance from the starting location to a common finish line on the straightaway. The straight section may have a rectangular shape in some embodiments or may be angled to accommodate the staggered starting positions such that the straight section extends further at lane 1 than at the outer lane.

This shows that attempts are being made to make the races fairer and more attractive through alternative racetrack design. However, there is still room for improvement for a racetrack layout.

SUMMARY OF THE INVENTION

Based on the known prior art, it is an object of the present invention to provide an improved racetrack layout increasing the possibility for overtake maneuvers while at the same time increasing the safety of the racetrack, especially during overtake maneuvers.

The object of the invention is solved by a racetrack, comprising a racetrack portion with at least a first segment and a second segment being branched-off from the racetrack and being merged into the racetrack, wherein the at least two segments are mostly identical in terms of length and/or travel time.

The racetrack portion is a part of a racing track, which is preferably composed of a sequence of curves, that is complemented by an alternative segment or path in such a way to enable a following pilot to choose the alternative segment or path to a leading pilot in front, while not being penalized as the chosen segment is mostly identical (in terms of length and travel time) to the one taken by the leading pilot, giving the following pilot the opportunity to be faster in the said racetrack portion, i.e. respective segment, than the leading pilot, and as a consequence to enable the following pilot to attempt an overtake maneuver.

The term curve could also be understood as turn or corner. Preferably, the racetrack is configured for being implemented in motorsports races but not limited to. The proposed racetrack design is also implementable on other forms of racing, e.g., running, cycling, horseback riding etc. In the following, the concept is described for motorsport pilots.

In one embodiment, the two segments are configured in such a way that they are identical in length and/or travel time. Travel time could also be understood as race time. With regard to the race time, it is assumed that the two segments would be driven under the same conditions, i.e., for a given vehicle, in identical weather, for identical track state and condition, same driver skills, same fuel load, same tires, etc., in the case of a motor racing circuit.

The term mostly identical is defined that the travel time and/or length between the two segments is within 0 to 10% difference, preferably between 0 and 2%. For example, a following pilot could still envisage choosing a segment which is longer by 2% in terms of travel time if the following pilot is faster than the leading pilot, e.g., 1 s per lap. If the time to go through the racetrack portion, especially the respective segments of the racetrack portion is for example 3s, 2% represents 0.06 s assuming the worst case for the following pilot that both pilots drive through the segments identically. If the following pilot is faster than the leading pilot by 0.1 s over the sequence of curves of that particular segment, even if the portion he/she takes is 2% slower, it leaves him/her with a residual advantage of 0.04 s, which might be enough to get alongside and attempt an overtake.

According to another embodiment, the racetrack portion comprises an entry zone, a middle zone, and an exit zone, wherein the first segment and the second segment are arranged in the middle zone. The entry zone is placed before the middle zone of the racetrack portion and the exit zone is placed after the middle zone of the racetrack portion.

The entry zone can be understood as an area with a certain length before the racetrack portion branches off. Preferably, the entry zone increases in width towards the middle zone and/or the exit zone decreases in width in direction of the exit of the racetrack portion. The entry zone can also be understood as braking zone.

The middle zone is defined by the point where the segments branch off (also the end point of the entry zone) and the point (start point of the exit zone) where the segments merge again.

Preferably, the length of the middle zone is greater than the length of the entry zone and/or exit zone.

According to another embodiment the entry zone and/or the exit zone consists of a length in the range of 1-5 times the track width, preferably, 3-4 times the track width.

This ensures that the racers have enough space to position themselves before entering or leaving the middle zone. This increases the safety of the racetrack portion.

Preferably, the racetrack portion is placed after a straight line leading to the racetrack portion and before a straight line leading away from the racetrack portion.

In an alternative embodiment, the racetrack portion is placed after a curve having a curve opening angle greater than 100° (preferably above) 130° or after a curve having a curvature radius in the range of 10-50 times the track width, preferably above 15 times, leading to the racetrack portion, and before a curve having a curve opening angle greater than 100° (preferably above) 130° or before a curve having a curvature radius in the range of 10-50 times the track width (preferably above 15 times.

This ensures that there is no strong bias towards one segment being better than the other one. For example, if the racetrack were designed so that there is a sharp bend or curve to the left or right before the racetrack portion, the pilots will exit this curve on the right hand/left hand side and will be more ready to take the left segment. The right/left segment will have inherent penalty, that should be corrected by artificially altering its length. Therefore, the proposed embodiment of having a straight line or a curve with an opening angle greater than 100° ensures that both segments are equally good to be taken by the pilots.

This ensures that the pilots have enough time to position themselves before entering into the racetrack portion and deciding which segment to take. This ensures the safety of the pilots.

In a further embodiment, the at least first segment and the second segment of the racetrack portion each comprises at least one curve between the entry zone and the exit zone, preferably two curves.

According to a further embodiment, the direction of the at least one curve of the first segment is configured such that it is arranged opposite to the at least one curve of the second segment. In other words, the at least one curve of the first segment is for example configured as a left-hand corner curve whereas the at least one curve of the second segment is for example configured as right-hand corner curve. In an example, such a configuration of the racetrack portion could also be designed as two segments which are arranged symmetrically to a length axis of the racetrack portion.

In an alternative embodiment, the direction of the at least one curve of the first segment is configured such that it is arranged in the same direction to the at least one curve of the second segment, i.e. the at least one curve of the first segment and the at least one curve of the second segment is for example configured as a left-hand corner curve or the at least one curve of the first segment and the at least one curve of the second segment is for example configured as a left-hand corner curve.

According to an embodiment of the invention, the first segment and the second segment of the racetrack portion comprises a chicane and a first straight line or a first segment portion with a curve opening angle greater than 100°, preferably above 130° before the chicane and a second straight line or a second segment portion with curve opening angle greater than 100°, preferably above 130° after the chicane, wherein the first straight line or the first segment portion of the first segment is shorter than the first straight line or the first segment portion of the second segment; and wherein the second straight line or the second segment portion of the first segment longer than the second straight line or the segment portion of the second segment The term "chicane" is defined as a S-Curve or in other words a set of at least two curves with opposite directions. For example, a chicane can be designed that after a left-hand corner curve a right-hand corner curve or vice versa is following.

This alternative layout of the racetrack portion minimizes the necessary area of land as the two segments are essentially parallel or synchronized to each other and arranged as close to each other as possible with a run-off area between the two segments. In one example, the first segment has a shorter straight line prior to the chicane, while having a slightly longer straight line after the chicane. Depending on the vehicle characteristics and the rest of the track layout, one path could happen to be slightly more advantageous than the other. In more detail, the segment with a longer straight line after the entry zone is more advantageous as the pilot can drive faster on this straight line compared to the straight line after the chicane where the pilot will accelerate. In other words, the first straight line could be travelled faster than the second straight line.

In a further preferable embodiment, the second segment comprises a geometrical difference compared to the first segment; wherein the geometrical difference is configured as a sharper curve within the chicane and/or smaller track width and/or higher length. Alternatively, the geometrical difference is configured as an additional segment portion leading to the exit zone comprising a further curve, preferably with an opening angle of 90-130°, so that the time advantage of the second segment compared to the first segment up to this point of the driven racetrack portion is compensated by a longer curve.

The term "sharper curve" is to be understood as curve with a smaller opening angle compared to the chicane of the first segment.

By this, the technical problem could be solved to propose a racetrack portion which minimizes the necessary area of land on the one hand and on the other hand to provide a racetrack portion with at least two segments which are almost identical in terms of travel time.

According to a further embodiment, the racetrack portion comprises a bridge or a tunnel so that the first segment and the second segment cross each other in a section above or below each other.

By this, the respective chicane of the first segment and the second segment can be designed to be largely identical in length and travel time and at the same time is more space-saving than a symmetrically arranged racetrack section.

According to a further embodiment, the racetrack portion comprises a run-off area and at least two safety barriers between the first segment and the second segment, wherein the safety barriers are arranged such that a chicane-like passage in the run-off area is created. In an example, the at least two safety barriers are arranged after the run-off area in view of the longitudinal direction and arranged alongside a portion of the first segment and the second segment.

In another embodiment, the width of the branch-off area and the merge is 1.5 to 5 times of the width of the rest of the racetrack, and/or the width of the first segment and the second segment is 0.5 to 2 times the width of the rest of the racetrack.

It could be discovered that the degree of difficulty of the individual segments can be varied by varying the width of the segments compared to the width of the rest of the racetrack.

Furthermore, the safety is increased by a wider entrance zone and exit zone compared to the width of the rest of the track.

BRIEF DESCRIPTION OF THE DRAWINGS

Further embodiments of the invention are explained in more detail by the following description of the figures.

DETAILED DESCRIPTION OF THE INVENTION

In the following, embodiments are described on the basis of the figures. In this context, identical, similar or similarly acting elements are provided with identical reference signs in the different figures, and a repeated description of these elements is partially omitted in order to avoid redundancies.

Figure 1A:
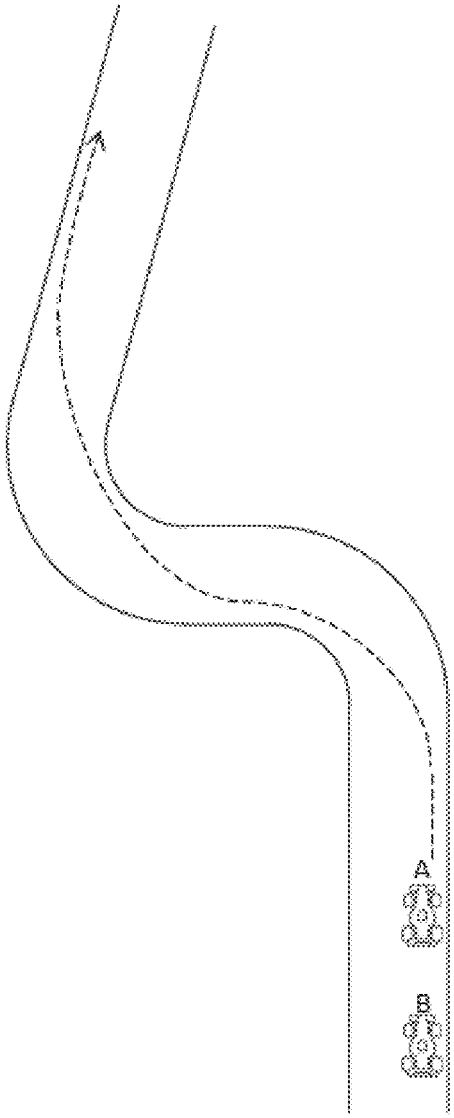
Fig. 1A PRIOR ART
FIGS. 1A-B depict a racetrack portion according to the state of the art.
Figure 1B:
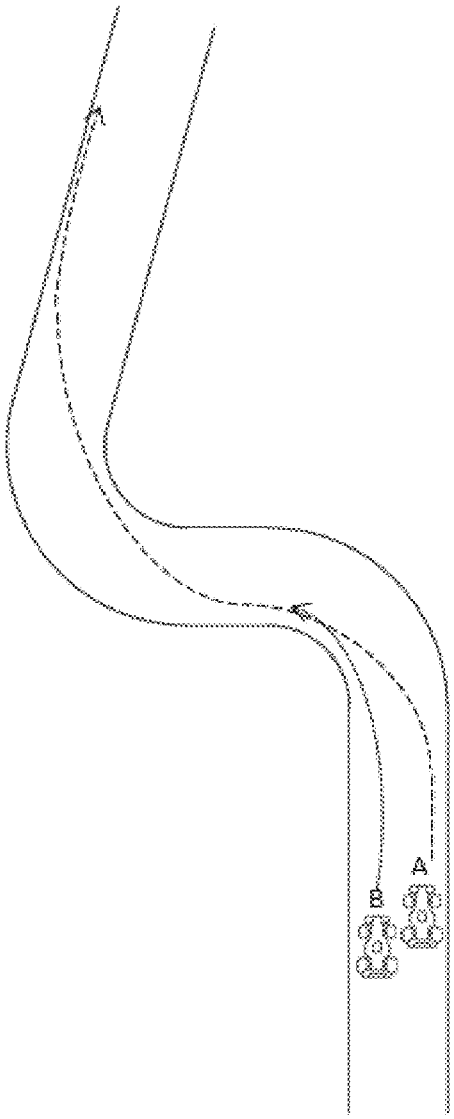
Fig. 1B PRIOR ART
Figure 2:
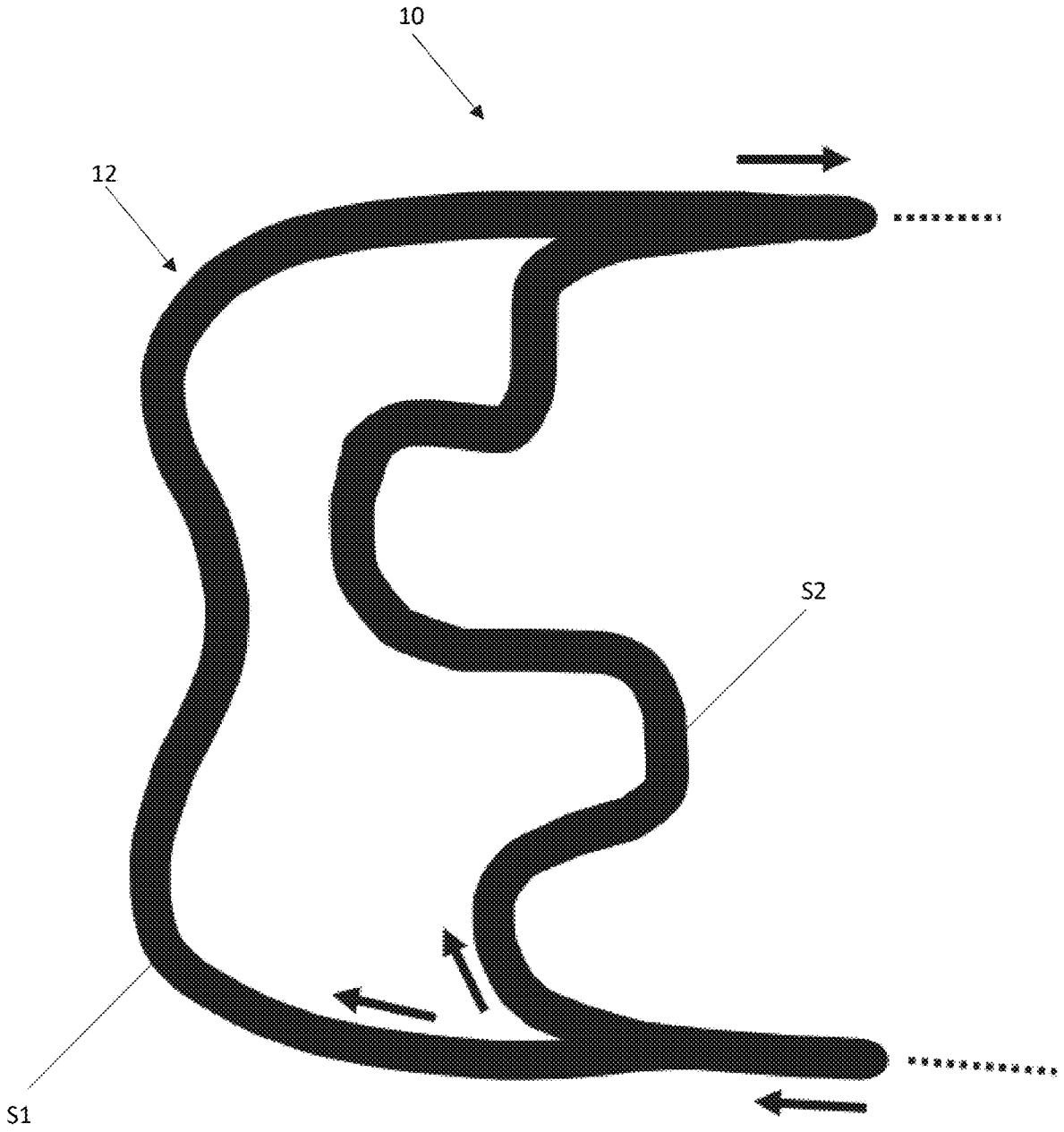
FIG. 2 depicts a racetrack portion with a first and a second segment according to an embodiment of the invention.

Referring to FIG. 2, an exemplary embodiment of a racetrack portion 12 of a racetrack 10 is illustrated. The racetrack portion 12 is configured such that a certain portion of the racetrack can be completed via at least two segments S1, S2. In other words, the racetrack 10 branches-off in at least two segments S1, S2 wherein the at least two segments S1, S2 are configured such that the at least two segments are mostly identical in terms of travel time and/or length. This is important because only in this case it is ensured that the pilots will freely choose different segments and thus an overtaking maneuver is possible. If one of the segments is significantly slower than the other, no pilot will choose that segment and thus the problem of designing a racetrack that facilitates overtaking maneuvers and increases safety at the same time would be missed. As shown exemplarily here, the first segment and the second segment are configured with a sequence of turns which are not identical in terms of configuration and length but travel time. The first segment S1 comprises for example more open turns compared to the second segment S2 comprising sharper turns. In the here shown example, the second segment S1 comprises rather sharp turns (for example turns with a total opening angle of less than 120°, preferably 90° or less) and the first segment with rather open turns (for example turns with a total opening angle of greater than 120°, preferably 90° or above). In an exemplary embodiment, the said sequence of turns is placed after a long straight or a long turn with large opening angles (e.g.)>100° and before another straight line or a long turn with large opening angles (e.g.)>100°. Further, the first segment and the second segment merge into the racetrack 10 in the direction of travel.

With regard to the comparison of the race time or travel time of the two segments to each other, it is assumed that the segments are driven under the same conditions, i.e. for a given vehicle, in identical weather, for identical track state and condition, same driver skills, same fuel load, same tires.

Figure 3A:
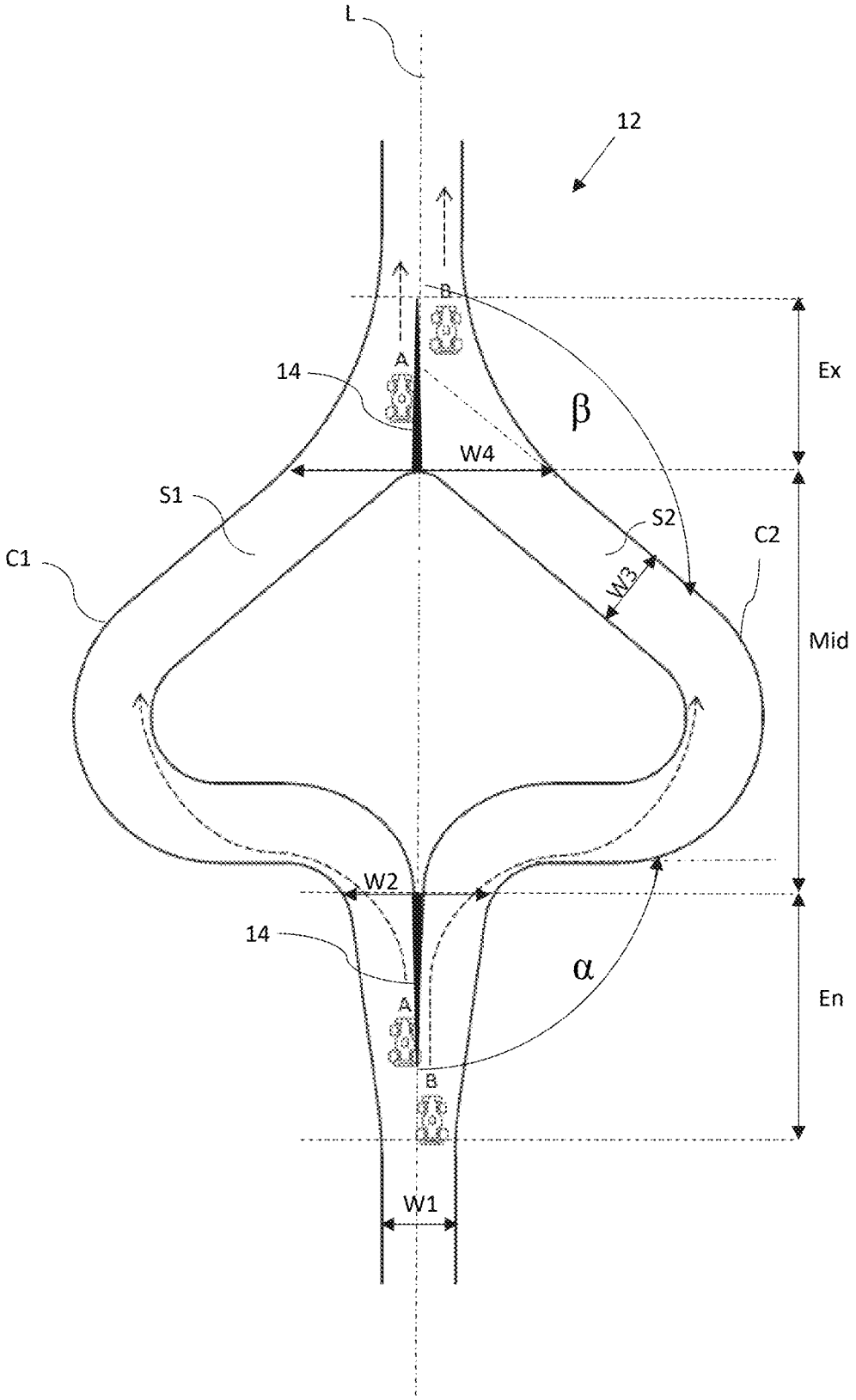
FIGS. 3A-D depict a racetrack portion with a first and a second segment which are arranged symmetrically to a longitudinal direction of the racetrack portion according to an embodiment of the invention.

According to another embodiment, and referring now to FIG. 3A, the racetrack portion comprises an entry zone En, a middle zone Mid, and an exit zone Ex, wherein the first segment S1 and the second segment S2 are arranged in the middle zone Mid. The entry zone En is placed before the branch-off of the racetrack and the exit zone Ex is placed before the merge of the racetrack.

The entry zone can be understood as an area with a certain length before the racetrack section branches off. In the here shown example, the entry zone consists of a length in the range of 3-4 times the track width. This ensures that the two pilots have enough time to prepare for the turns in the two segments. However, the length of the entry zone can vary and be adopted in relation to the angle of the first turn of the middle zone.

According to the example shown in FIGS. 3A-3D, the direction of the at least one curve of the first segment S1 is configured such that it is arranged opposite to the at least one curve of the second segment S2. For example, the at least one curve C1 between the entry zone En and the exit zone Ex of the first segment S1 is a right-hand corner curve whereas the at least one curve C2 of the second segment S2 is a left-hand corner curve. As exemplarily shown, the racetrack portion is designed with two segments which are arranged symmetrically to a length axis L of the racetrack portion. This configuration of a mirrored sequence of curves guarantees the best fairness between pilots, with equal (symmetrical) piece of track. Preferably, two sharp corners in a sequence per segment, alternating left and right hand-side or vice versa for the respective segment, called a chicane or flip-flop, is optimum for the proposed racetrack portion.

The racetrack portion configurations shown in FIG. 3A-3D show a first segment which is identical in structure and length to the second segment. For example, the curves leading to the first segment and the second segment have two turns comprising an angle $\alpha$ of less than 120°, see FIG. 3A. This ensures that the pilots approach their respective segment at a slow speed, which increases the safety for the pilots.

Further, a separating device 14 is placed along the middle axis of the entry zone and/or a further separating device is placed along the middle axis of the exit zone Ex limiting the exit area Ex of the racetrack portion 12. In an example the separating device 14 is configured as a white line, kerb, barrier or the combination thereof. In an example, the separating device 14 blends into a track limit, preferably a kerb or a run-off area, preferably a gravel trap. The separation device 14 which can extend at least partially, preferably over the entire length of the entry zone En and/or exit zone Ex.

The length of the separating device can be adjusted depending on the level of difficulty of the racetrack portion. This ensures that the pilots do not collide before entering the middle zone. This increases the safety of the racetrack design. In an example, when entering into a curve of greater than 120°, preferably 90°, the length of the separating device is between 2 and 5 times the track width, preferably 3 time the track width. For curves less than 90° when entering the middle zone, the length of the separating device can be 1-3 times the track width. The beginning of the separating device, preferably represented by a white line blending into a kerb, represents the last decision point for the pilots as to which segment to take. Past the white line, the pilot can't cross it anymore to choose the other segment.

The width W1 of the racetrack and the entry zone can be different. In an example shown here, the width W2 of the entry zone at the end is wider than the width W1 of the rest of the racetrack. In a further embodiment, the width W2 of the branch-off area and the merge W4 is 1.5 to 5 times, preferably 2 to 3 times of the width of the rest of the racetrack.

This ensures that the racers have enough space to position themselves before entering the middle zone Mid. This ensures the safety of the pilots.

Further, the width W3 of the first segment and the second segment is 0.5 to 2 times the width W1 of the rest of the racetrack. Preferably it is 0.5 to 1 times the width of the rest of the racetrack. By this, the racetrack can be made more difficult to drive for the pilots which increases the attractiveness of the racetrack.

As shown here, the turn B leading to the exit zone is more open which allows a pilot to drive into the exit zone with higher speed. This makes the race very attractive, as the pilots enter the final zone of the racetrack portion at very high speed. Preferably, the angles β of the turn are greater than 120.

Figure 3B:
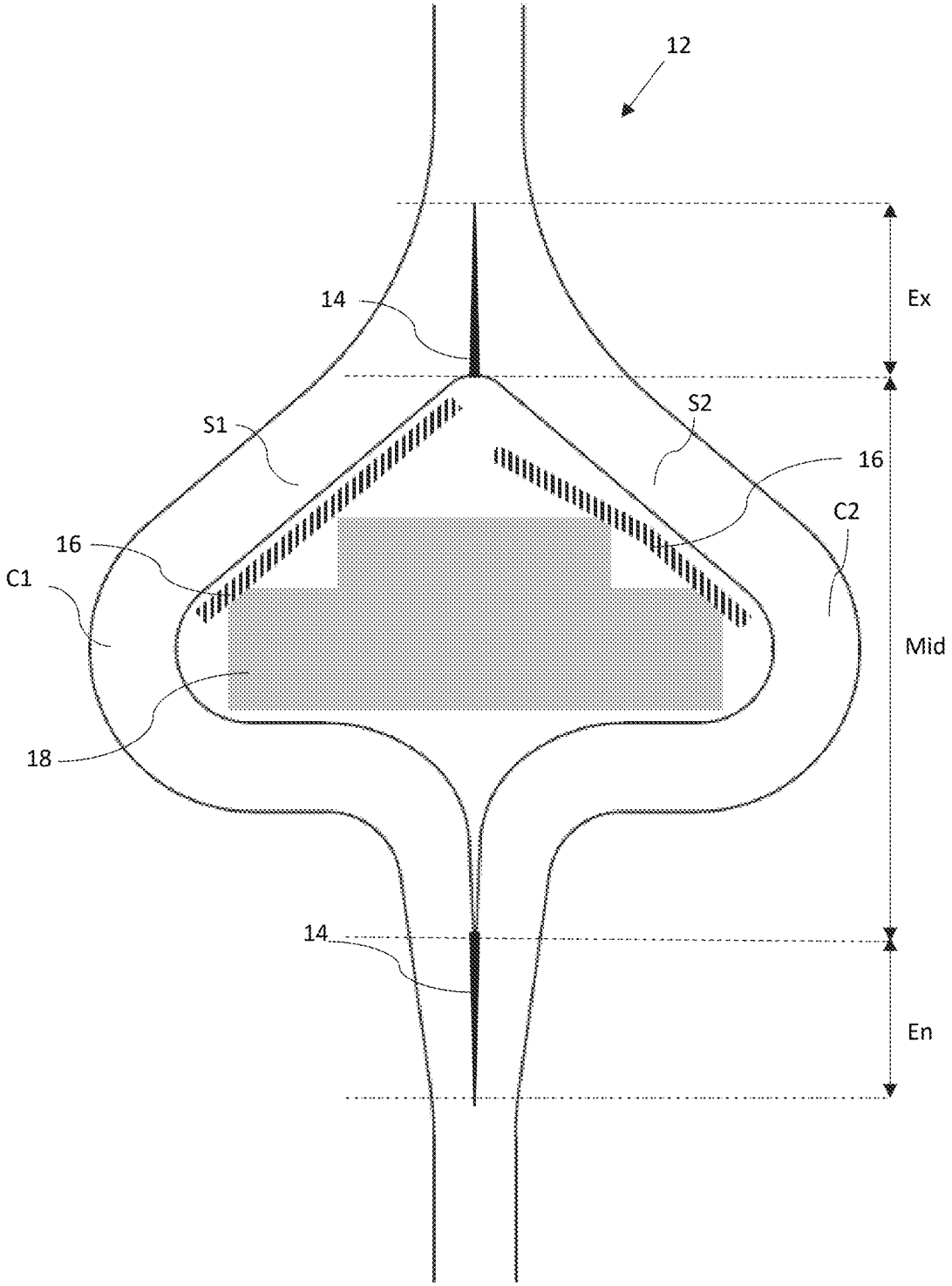
Figure 4A:
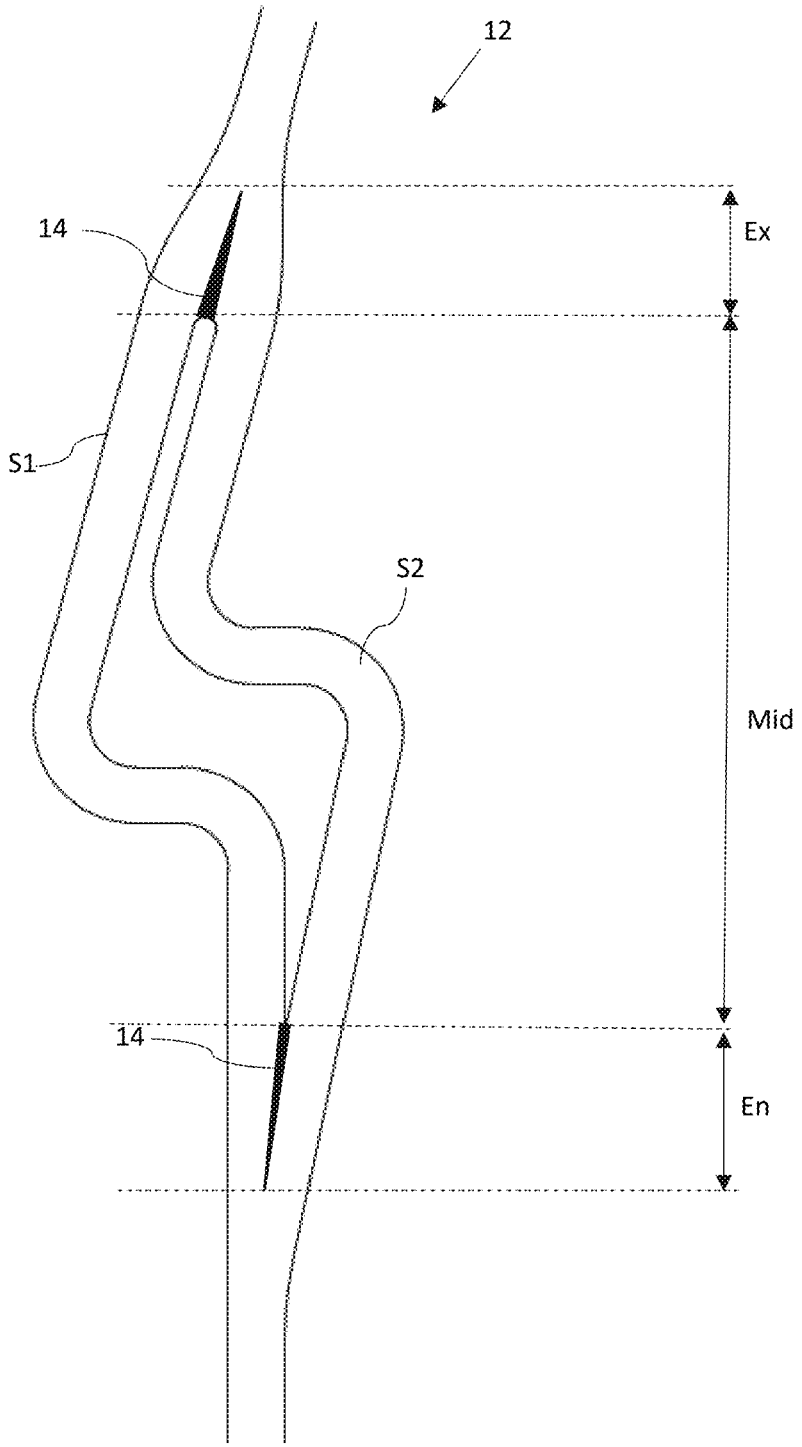
FIGS. 4A-D depict a racetrack portion with a first and a second segment which are arranged in a synchronized manner according to an embodiment of the invention.
Figure 4B:
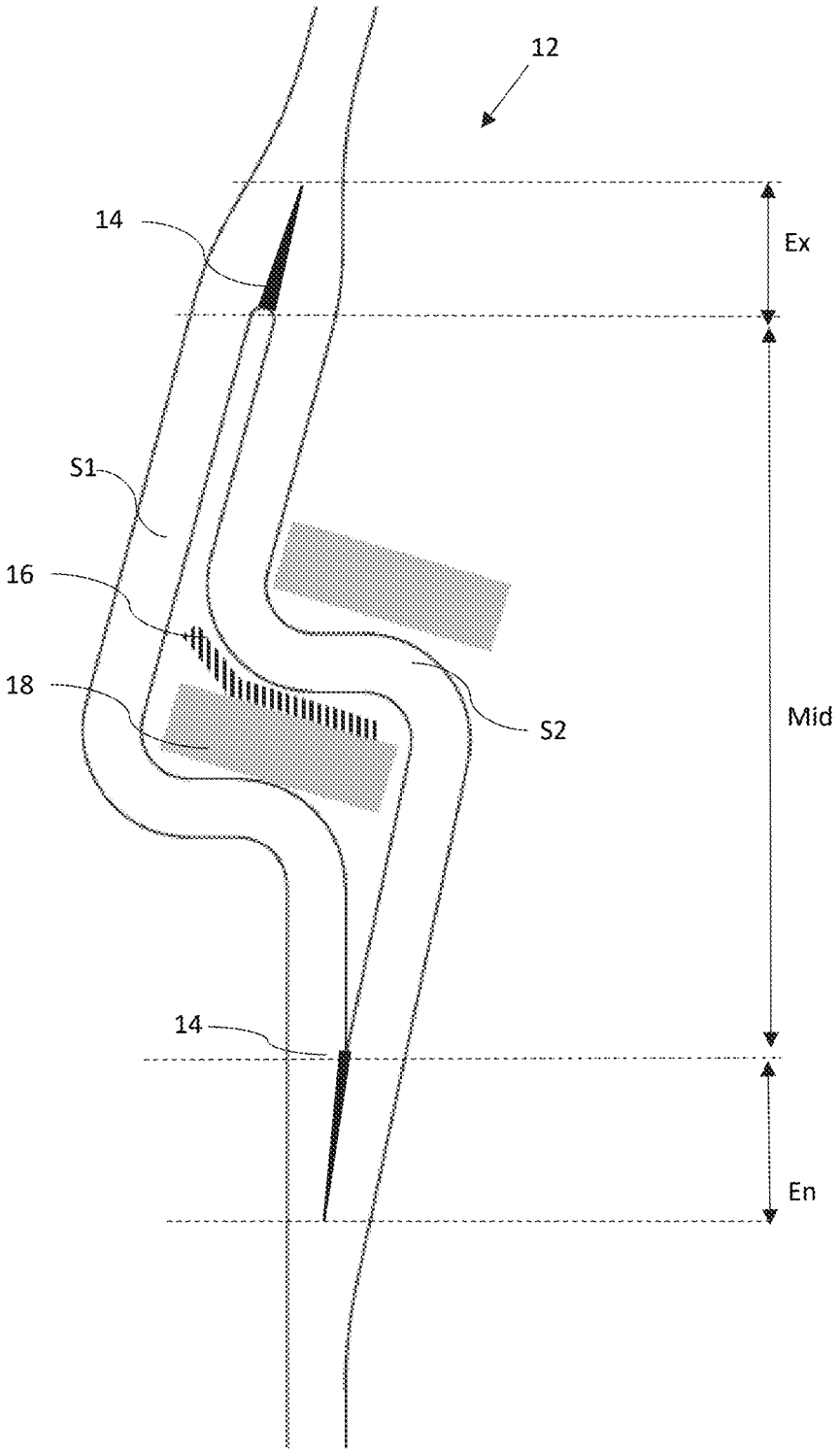

Referring now to FIG. 3B and FIG. 4B, a further embodiment of the racetrack portion is shown. A run-off area 18 is arranged in the middle of the two segments S1, S2, e.g., double chicane, to enable a pilot making a mistake to run off-track and come back after having slowed down. Further, safety barriers 16 are installed in order to prevent a high-speed car crashing into another and placed in such a way to force a car going in the run-off area 18 to re-join the racetrack at low speed, through an opening (see for FIG. 3B) creating a very slow chicane, while providing good visibility on the incoming cars.

As exemplarily shown, a kerb or a white line 14 extends from a starting point of the entry zone En to the beginning of the double chicane. This forces the pilots to select a segment well in advance to avoid that the pilot choosing one path, change his/her mind and switch to the other path, creating a potential hazardous situation if the pilot behind can't anticipate such a move.

Figure 3C:
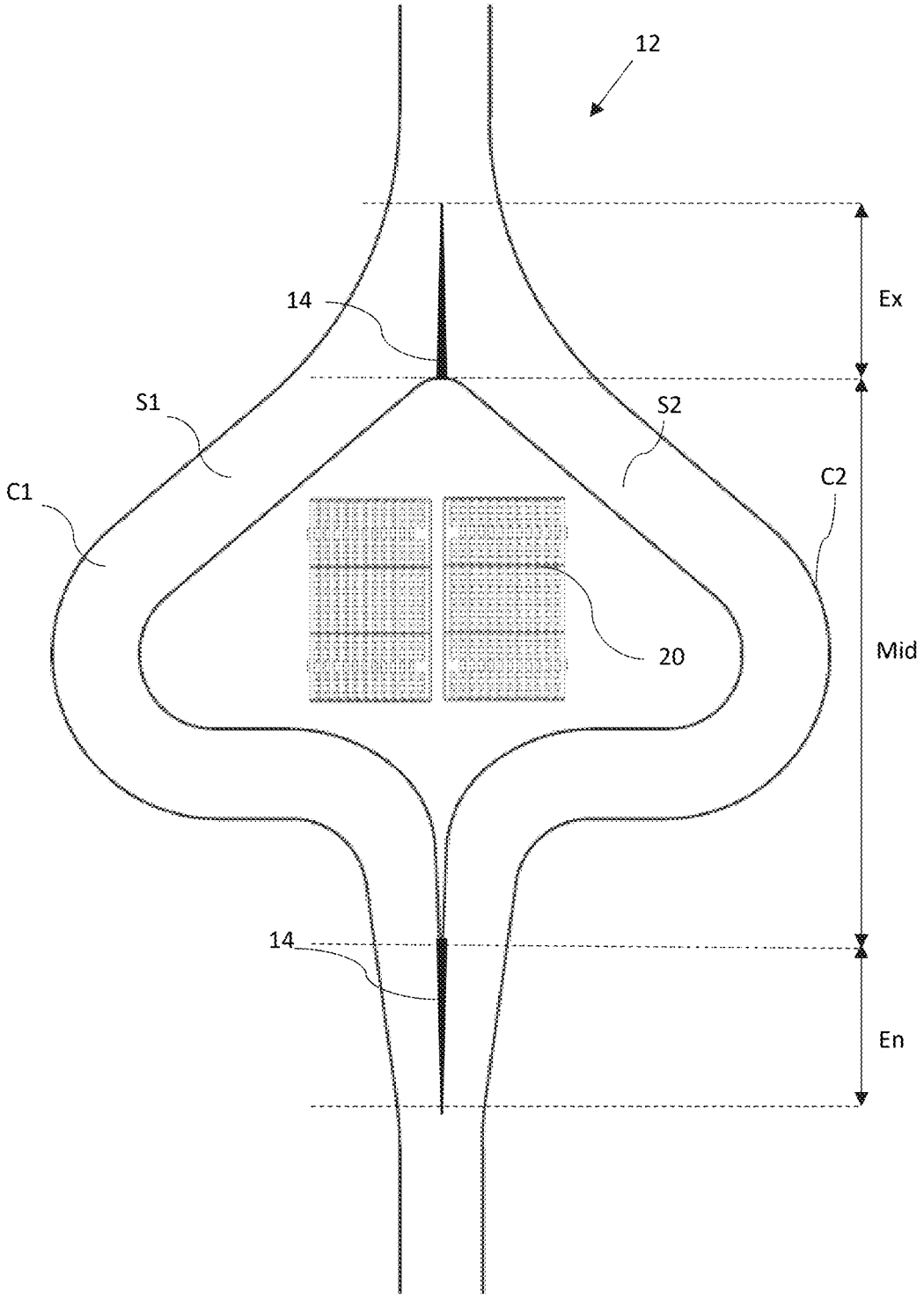

Furthermore, in an alternative embodiment, spectator stands can be placed between the two segments, see FIG. 3C.

Figure 3D:
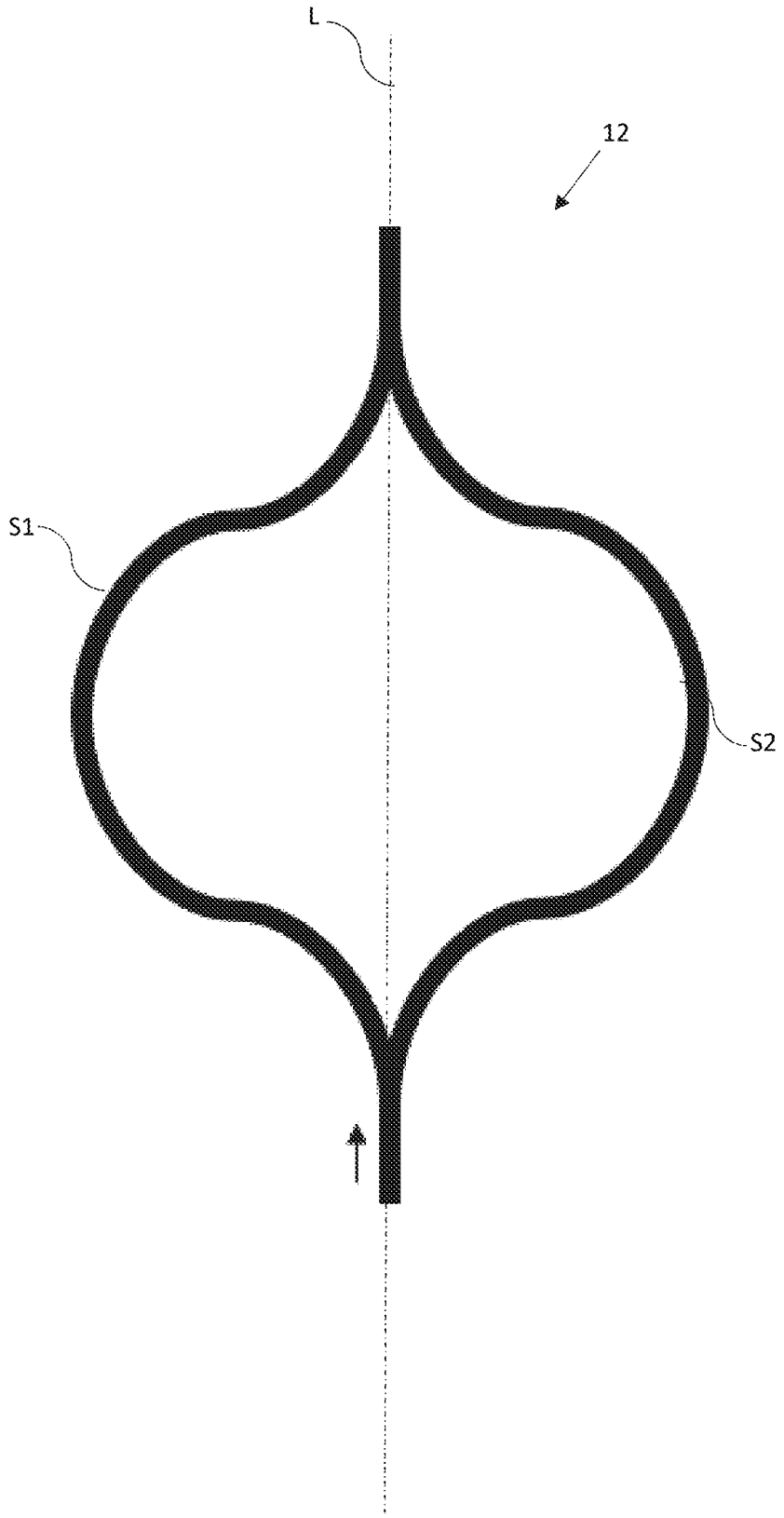

FIG. 3D shows a further alternative embodiment of the racetrack portion. As shown here, the turns of the first segment and the second segment comprise more open and fast turns (opening angle above) 120°. This results in a fast portion of the track.

FIG. 4A shows an alternative embodiment of the proposed racetrack portion, wherein in contrast to the "symmetrical" designed racetrack portion, the two segments are arranged in "parallel" to each other, i.e. that the curves are generally of the first segment and the second segment are directed in the same direction. For example and as shown in FIGS. 4A and 4*b*, the curve of the first segment and the second segment are both left-hand corner curves followed by a right-hand corner curves.

In the here shown example, the first segment S1 and the second segment S2 of the racetrack portion comprises a chicane and a first straight line SL11, SL21 before the chicane and a second straight line after SL12, SL22 the chicane. The first straight line SL11 of the first segment S1 is shorter than the first straight line SL21 of the second segment S2. The second straight line SL12 of the first segment S1 is longer than the second straight line SL22 of the second segment S2.

This alternative layout minimizes the necessary piece of land by using two "parallel" segments instead of mirrored. The drawback is that one path has a slightly shorter straight line prior to the double chicane, while having a slightly longer straight line after the chicane. Depending on the vehicle characteristics and the rest of the track layout, one path could happen to be slightly more advantageous than the other. In more detail, the segment with a longer straight line after the Entry Zone En, as shown here for the second segment S2, is more advantageous as the pilot can drive faster on this straight line SL21 compared to the straight line SL12 after the chicane where the pilot will accelerate.

Figure 4C:
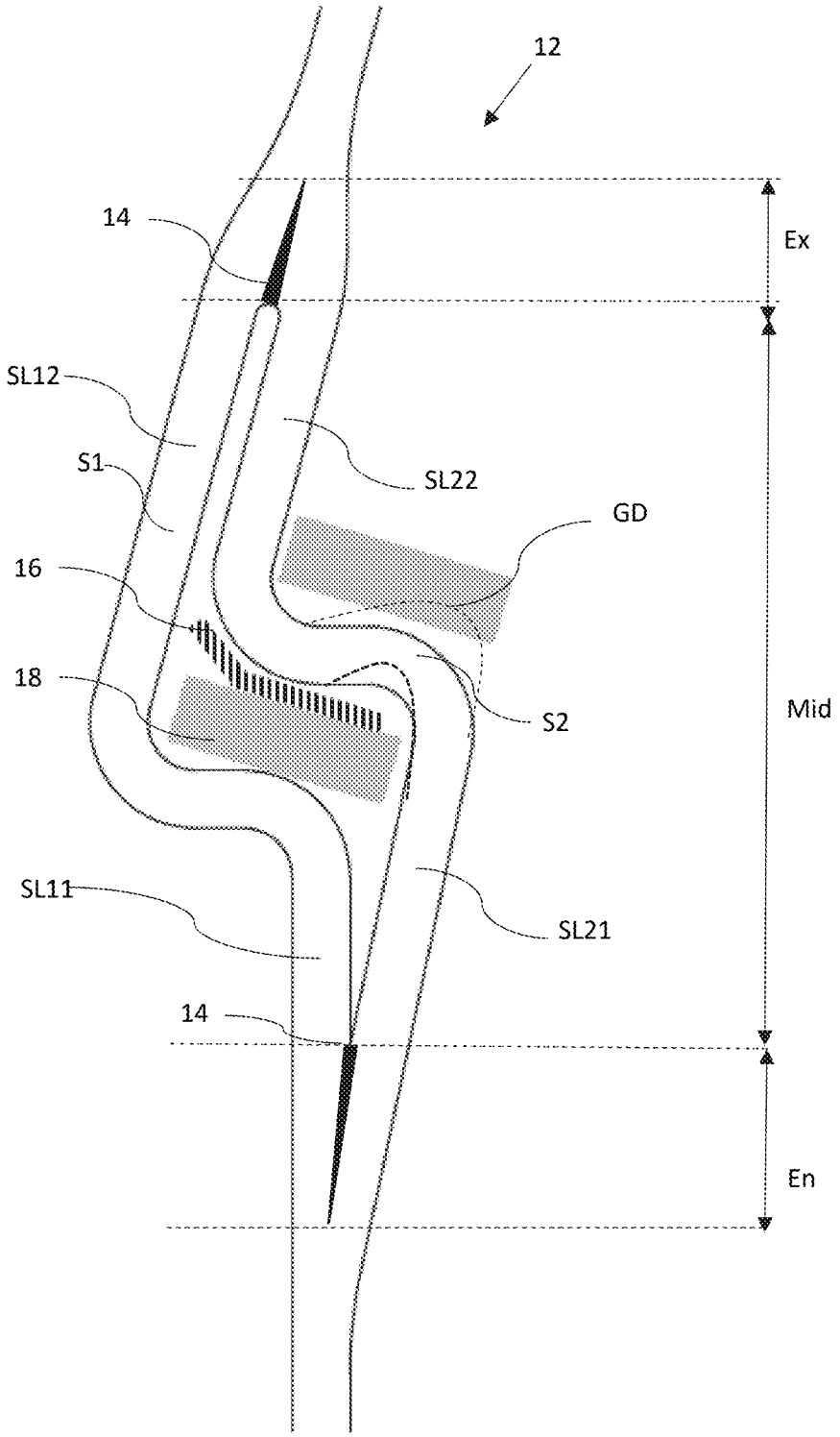

Referring to FIG. 4C, assuming that the average speed on the straight line of first segment SL12 is V1 and slower than the average speed V2 of the straight line of second segment SL21, and assuming the length of straight line SL12 is the same as the length of the straight line SL21, and assuming the speed through the other curves and straight lines of both segments are identical, the travel time t1 for a pilot on the first segment is greater than the travel time t2 of the second segment, leading to a time difference of delta $t=t_1-t_2=L_{12}/V_1-L_{21}/V_2=L\ (1/V_1-1/V_2)$ (with $L_{21}=L_{12}$)

Thus, the second segment is modified such that the delta_t between the straight lines SL12 and SL21 of the first segment and the second segment is compensated and the two segments are identical in terms of travel time.

Figure 4D:
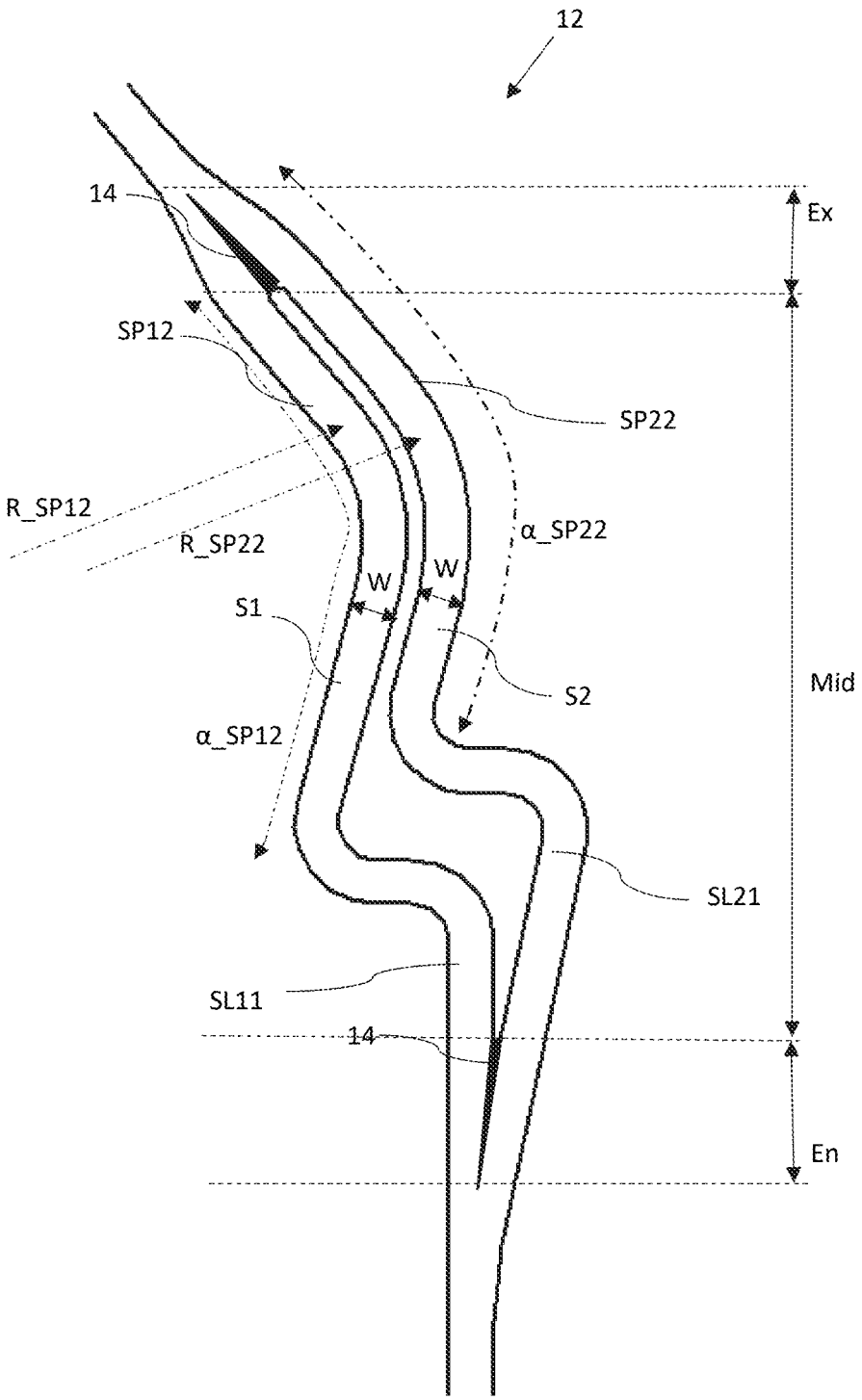

In an embodiment by referring to FIG. 4C, the second segment S2 comprises a geometrical difference GD compared to the first segment, wherein the geometrical difference is a sharper curve within the chicane (as shown here by the dashed alternative curve) and/or smaller width and/or higher length of the chicane, and/or a different shape of the segment portion leading to the exit zone as shown in FIG. 4D.

For example, the travel time through the curves of middle zone of the second segment is delta_t longer to the travel time of the corresponding curves in the middle zone of the first segment).

In an example, the chicane is designed such that V1<0.5 V2 leading to a higher degree of modification of the second segment compared to segment 1.

In another example, a high speed version of the racetrack is designed such that V1>0.9 V2 which minimizes delta_t leading to a higher degree of modification of the second segment compared to segment 1.

Alternatively and referring to FIG. 4D, the geometrical difference of the second segment compared to the first segment is configured as an additional segment portion SP12, SP22 leading to the exit zone Ex comprising a further curve, preferably with an opening angle of 90-150°, so that the time advantage of the second segment compared to the first segment up to this point of the driven racetrack portion is compensated by a longer curve in the segment portion SP22 leading to the exit zone of the second segment S2.

In an example, the two curves are designed so that the travel time t_SP22 for driving the segment portion SP22 is equal to the travel time t_SP12 for driving SP12 plus the time advantage of the second segment delta_t with $$t_{_SP22}=L_{_SP22}/V_{_SP22}, \text{ with } L_{_SP22}=\text{alpha}_{_SP22}(\text{in radian})\times R_SP22(\text{radius})$$

$$t_{_SP12}=L_{_SP12}/V_{_SP12}, \text{ with } L_{_SP12}=\text{alpha}_SP12(\text{in radian})\times R_SP12(\text{radius})$$

In an example, it is preferable that the radius R_SP12 is at least greater than 90°, preferably more than >120° and the width of segment portion SP12, SP22 is greater than 3 times the racetrack width or preferably 5 time the racetrack width so that the vehicle to go through the segment portions SP12, SP22 leading to the exit zone do not need braking so that the travel time is then easier to predict (it can be assumed V_SP22=V_SP12).

If R_SP12 satisfies this condition, R_SP22 will as well, as R_SP22>R_SP12.

Thus, complying to above-described geometrical conditions of the segment portions SP12, SP22 leading to the exit zone, the two segment portions are linked by this equation: alpha_SP22×R_SP22-alpha_SP12×R_SP12=V×delta_t.

By this, the technical problem could be solved to propose a racetrack portion which minimizes the necessary area of land on the one hand and on the other hand to provide a racetrack portion with at least two segments which are almost identical in terms of travel time.

In more detail, one of the segments is modified such that the two segments of the racetrack portion are identical in terms of time.

Figure 5:
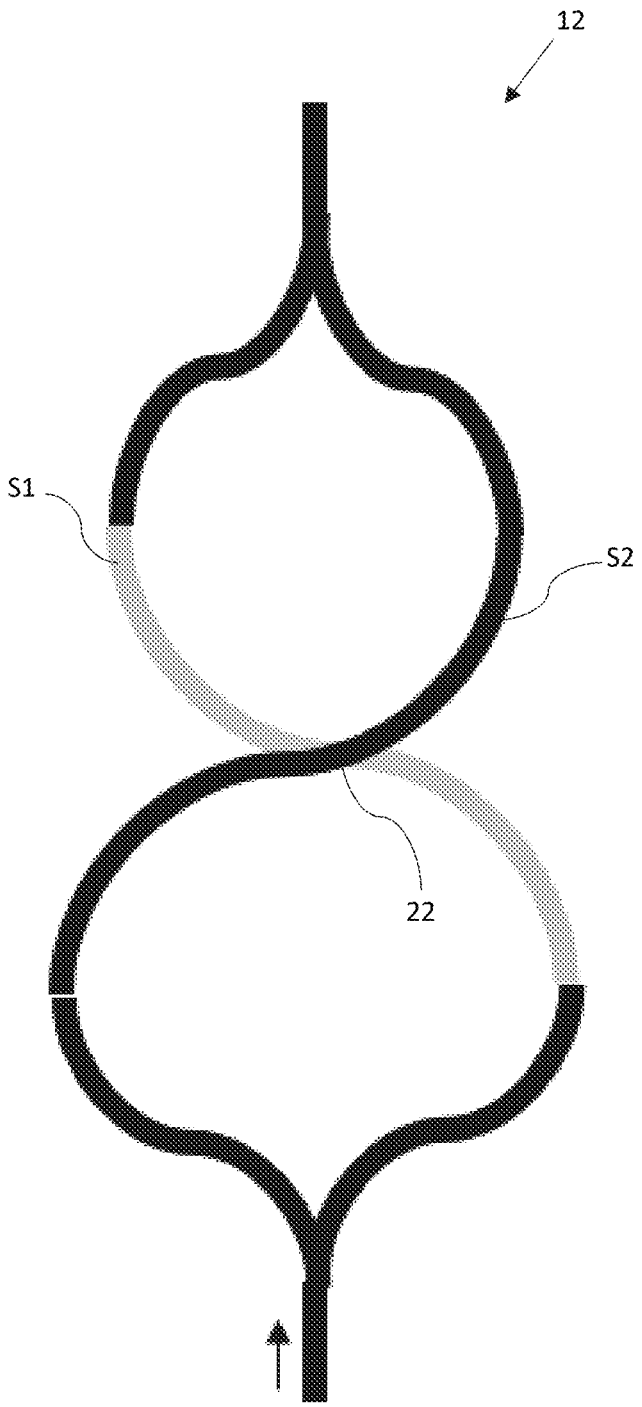
FIG. 5 depicts a racetrack portion comprising a tunnel or a bridge according to an embodiment of the invention.

FIG. 5 shows a further alternative embodiment of the proposed racetrack portion 12. The here shown example shows two segments crossing each other, by means of a bridge 22 for the elevated portion of the track, and/or by means of a tunnel 22 for the lower section of the track.

The here described racetrack portion is advantageous over prior art as a pilot following another one and being only slightly faster than the pilot in front is still enabled to make an overtake maneuver, which wouldn't be possible for a conventional racetrack. Artificial devices like DRS or temporary boosts can be omitted.

In the case a pilot is 0.1 s faster than another one through a sequence of corners and driving at an average travel speed of 200 km/h (or 55.56 m/s), this represents a gap to the car in front reduced by 5.56 m. This is approximately a full length of a car. If the pilot following another one is close enough, after a straight line for example, the alternative segment enables the following pilot to be significantly alongside or ahead the opponent (as shown in FIG. 3A) creating an exciting wheel-to-wheel situation and an overtake opportunity ahead of the next corner.

The term "alongside" is defined as the condition where the front axle of a following pilot is positioned ahead of the rear axle of pilot A (not shown here). When this condition is met, the leading pilot is no longer allowed to block or cut off the following pilot. This ensures that the goal of providing the following pilot with a better starting position for overtaking is achieved.

For example, with the proposed racetrack portion a lap time advantage of 0.1 s could be sufficient to create an overtake, while for a conventional racetrack, an overtake might require 1 to 2 s difference in lap time (or powerful DRS zone, or boost). It is much more frequent to have differences in lap times of a couple of tenths of a second, rather than in the order of magnitude of 1 s, hence a possible multiplication of overtakes and at least wheel-to-wheel battles could be realized.

What is claimed is:

1. A racetrack, comprising:

a racetrack portion comprising:

an entry zone;

an exit zone;

a first segment comprising at least one curve between the entry zone and the exit zone; and a second segment comprising at least one curve between the entry zone and the exit zone wherein the first and second segments are branched off from the racetrack at the entry zone and being merged into the racetrack at the exit zone;

wherein a direction of the at least one curve of the first segment is configured such that it is arranged in the same direction to the at least one curve of the second segment; and wherein the first and second segments are within a range from 0% to 10% difference to each other in terms of at least one of length or travel time.

2. The racetrack according to claim 1, wherein at least one of the entry zone or the exit zone comprises a length within a range of one of 1 to 5 times a width of the track or within 3 to 4 times the width of the track.

3. The racetrack according to claim 1, wherein the racetrack portion is placed after a straight line leading to the racetrack portion and before a straight line leading away from the racetrack portion.

4. The racetrack according to claim 1, wherein the racetrack portion is placed at least one of after a curve having a curve opening angle that is one of greater than 100° or greater than 130°, or after a curve having a curvature radius that is one of within a range from 10 to 50 times a width of the track or greater than 15 times the width of the track leading to the racetrack portion, and at least one of before a curve having a curve opening angle that is one of greater than 100° or greater than 130° or before a curve having a curvature radius that is one of within a range from 10 to 50 times the width of the track or greater than 15 times the width of the track.

5. The racetrack according to claim 1, wherein a curve angle of the at least one curve of the respective segment is at least one of less than 120° or less than 90°.

6. The racetrack according to claim 1, wherein the first segment and the second segment of the racetrack portion comprises a chicane and one of a first straight line or a first segment portion with a curve opening angle that is one of greater than 100° or greater than 130° before the chicane, and one of a second straight line or a second segment portion with a curve opening angle that is one of greater than 100° or greater than 130° after the chicane;

wherein the first straight line or the first segment portion of the first segment is shorter than the first straight line or the first segment portion of the second segment; and wherein the second straight line or the second segment portion of the first segment is longer than the second straight line or the segment portion of the second segment.

7. The racetrack according to claim 6, wherein the second segment comprises a geometrical difference compared to the first segment; wherein the geometrical difference is configured as at least one of a sharper curve, a smaller track width, a higher length, or as an additional segment portion leading to the exit zone comprising a further curve so that a time advantage of the second segment compared to the first segment up to this point of the driven racetrack portion is compensated by a longer curve.

8. The racetrack according to claim 7 wherein the further curve has an opening angle within a range from 90° to 150°.

9. The racetrack according to claim 1, wherein the racetrack portion comprises a run-off area and at least two safety barriers between the first segment and the second segment, wherein the safety barriers are arranged such that a chicane-like passage in the run-off area is created.

10. The racetrack according claim 1, wherein a width of the branch-off area and the merge is within a range of 1.5 to 5 times of the width of the rest of the racetrack.

11. The racetrack according to claim 1, wherein a width of the first segment and the second segment is within a range from 0.5 time to 2 times a width of the rest of the racetrack.

* * * * *